US005208570A

United States Patent [19]

Nippert

[11] Patent Number: 5,208,570

[45] Date of Patent: May 4, 1993

[54] SOLENOID CONSTRUCTION AND METHOD FOR MAKING SAME

[75] Inventor: Andrew H. Nippert, Peoria, Ill.

[73] Assignee: Caterpillar Inc., Peoria, Ill.

[21] Appl. No.: 864,248

[22] Filed: Apr. 6, 1992

[51] Int. Cl.[5] ..... H01F 3/00; H01F 7/08

[52] U.S. Cl. ..... 335/261; 335/255

[58] Field of Search ..... 335/255-262; 251/129.15

[56] References Cited

U.S. PATENT DOCUMENTS

| | | | |
|---|---|---|---|
| Re. 32,783 | 11/1988 | Clark | 335/261 |
| Re. 32,860 | 2/1989 | Clark | 335/261 |
| 4,539,542 | 9/1985 | Clark | 335/261 |
| 4,604,600 | 8/1986 | Clark | 335/261 |
| 5,050,840 | 9/1991 | Kondo et al. | 251/129.15 |

*Primary Examiner*—Harold Broome

*Attorney, Agent, or Firm*—Alan J. Hickman

[57] ABSTRACT

An assembly is provided for use in a solenoid having an energizable coil. The apparatus includes a ferromagnetic main body member adapted to be received in the coil. An armature chamber having a constant diameter is disposed in the main body member. A radially externally facing taper is formed in the outer surface of the main body member. The taper extends between the armature chamber and the outer surface of the main body member. A stationary pole piece and an end plug respectively define a first and second end of the armature chamber. An armature member is positioned in the armature chamber for axial sliding movement relative to and defining a working gap relative to the pole piece. The armature includes a fluid passage adapted to provide nonlaminar fluid flow. A nonferromagnetic sleeve is positioned on and fixedly connected to the main body member. The sleeve is linearly coextensive with the externally facing taper and at least a portion of the working gap sufficient to permit selected magnetic forces to be exerted on the armature member. A junction of the sleeve and the externally facing taper define an air gap which extends from the externally facing taper to an internal radial surface. The stationary pole piece and the main body member are manufactured from a single piece of ferromagnetic material and the armature chamber is formed subsequent to fixing the sleeve to the main body member.

14 Claims, 4 Drawing Sheets

SOLENOID CONSTRUCTION AND METHOD FOR MAKING SAME

DESCRIPTION

1. Technical Field

This invention relates to solenoids and methods for making the same and in particular proportional type solenoids.

2. Background Art

Proportional solenoids are well known in the art to provide a force versus stroke curve which allows the output force of the solenoid to be proportional to the electrical current applied to the coil and which is independent of armature position over the working range of stroke. This proportionality of the output force permits such a solenoid to either fully or partially operate a load by selectively applying either full or partial electrical current to the solenoid coil, thereby delivering a selective output force.

U.S. Pat. No. 4,539,542, hereinafter '542, which issued to Clark on Sep. 3, 1985 and reissued on Nov. 16, 1988 as RE 32,782 and U.S. Pat. No. 4,604,600, hereinafter '600, which issued to Clark on Aug. 5, 1986 and reissued on Feb. 7, 1989 as RE 32,860 are illustrative of the typical designs of prior proportional solenoids. The solenoid design of '542 is illustrated generally in FIG. 1 and because the design of '600 is essentially the same, it has not been illustrated. The solenoid 10 utilizes what is referred to herein as a three-piece tube assembly. More specifically, the solenoid 10 includes a hollow guide tube 12 which has a one end press fitted or otherwise permanently fixed to a stationary or fixed magnetic pole piece 14 made of ferromagnetic material. Although not explicitly described in '542 or '600, known production solenoids of this design also have an end cap 16 which is permanently mounted to the other end of the guide tube 10. The composite three-piece tube assembly is received and mounted in a solenoid coil (not shown). The guide tube 12 defines an armature chamber 20 which is adapted to receive armature or core 22 made of ferromagnetic material. The armature 22 moves longitudinally in the armature chamber 20 to a position responsive to the magnitude of a magnetic flux path established by the solenoid coil.

The guide tube 12 is described in '542 and '600 as preferably being a one-piece metal tube made of magnetic stainless steel material. The guide tube 12 includes two magnetic end sections 24, 26 and a nonmagnetic middle section 28. The nonmagnetic section 28 is linearly coextensive with the working gap of the armature 22. Although neither '542 or '600 describe how to obtain a single guide tube of this construction, known manufacturing processes include heat-treating the guide tube 12 to achieve the desired magnetic properties. However, the heat treating process can distort the guide tube 12, thereby making it difficult to maintain design tolerances and tube concentricity. Moreover, localized heat treating cannot provide a distinct transition between the magnetic and nonmagnetic regions.

The descriptions of '542 and '600 also mention that the guide tube 12 can be constructed by brazing or welding together a multiple section tube having at least one nonmagnetic section, in lieu of the one piece tube. Such a multiple-section design is undesirable, however, because of the added manufacturing difficulties associated with such a design. More specifically, the multiple piece, multiple metal design results in excessive tolerance stackup in the length of the tube. Additionally, such a construction makes it difficult to maintain concentricity of the tube 12. Moreover, the welding or brazing process can induce shrinkage and warping, making it difficult to maintain design tolerances and concentricity.

Regardless of which tube design is employed, the tube design of '542 and '600 suffers from additional problems. Because the pole piece 14 and the end cap 16 are permanently fixed to the tube 10, it is impossible to check for contamination, such as metal shavings, once the solenoid 10 is assembled. Additionally, the tube design of '542 only provides minimal resistance to side loadings, vibration and shock. This is especially a problem in applications such as construction vehicles where the solenoids are often exposed to extreme conditions. For example, it is common for the tube 12 to be fractured or bent by external forces such as those exerted when an operator accidentally steps on the solenoid 10.

U.S. Pat. No. 5,050,840, hereinafter '840, which issued to Kondo et al. on Sep. 24, 1991, recognizes and addresses some of the problems associated with '542 and '600. The solenoid design of '840 is generally illustrated in FIG. 2. In particular, '840 provides a removable end cap 16 which makes it possible to remove the armature 22 for servicing in the event that the solenoid 10 fails. Additionally, '840 provides a set screw 30 which can be used to adjust the position of the armature 22 within the tube, thereby making it possible to compensate for tolerance stackup in the length of the tube 12.

However, the set screw 30 presents additional problems because it is possible for the screw 30 to come loose during operation of the solenoid 10. This is especially true when the solenoid 10 is used on construction vehicles where extreme vibrations and shocks occur. If the set screw 30 comes loose, it is possible for undesirable fluid leakage to occur. Additionally, if the set screw comes loose, the stroke length of the solenoid may be lengthened or shortened and performance of the solenoid will be affected in an unpredictable manner. Moreover, '840 utilizes a tube design which still suffers from the inability to resist substantial side loading and does not address the manufacturing problems associated with '542 and '600.

'840 is illustrative of additional problems associated with known solenoids. More specifically, when the solenoids are to be used in operating hydraulic valves, it is necessary to provide a fluid passage 32 in the armature 22. '840 and other known solenoids employ an oil passage which consists of a single longitudinal bore in the armature 22. This fluid passage 32 permits fluid to flow through the armature 22 when the armature 22 moves within the armature chamber 20. However, fluid passages of this design result in armature dampening which is extremely sensitive to changes in fluid viscosity due to changes in temperature, thereby making it difficult to design a control system which can accurately control the solenoid 10 over a wide range of temperatures.

The present invention is directed to overcoming one or more of the problems set forth above.

DISCLOSURE OF THE INVENTION

FIGS. 1 and 2 are cross-sectional views of typical prior art proportional solenoids;

FIGS. 3 and 4 are cross-sectional views of an embodiment of the present invention;

FIGS. 5 and 6 are cross sectional views of the present invention employing a second embodiment of the preferred fluid passage; and FIGS. 7, 8 and 9 are cross-sectional views illustrating the steps for manufacturing a solenoid tube in accordance with the present invention.

BRIEF DESCRIPTION OF THE DRAWINGS

In a first aspect of the present invention an assembly is provided for use in a solenoid having an energizable coil. The apparatus includes a hollow solenoid armature tube adapted to be received in the coil. An armature chamber is disposed in the armature tube. A stationary pole piece member defines a first end of the armature chamber and an end plug defines a second end of the armature chamber. The assembly further includes an armature member having a fluid passage adapted to provide nonlaminar fluid flow. The armature member is positioned in the armature chamber for axial sliding movement relative to and defining a working gap relative to the pole piece.

In a second aspect of the present invention, an assembly is provided for use in a solenoid having an energizable coil. The apparatus includes a ferromagnetic main body member adapted to be received in the coil. An armature chamber of a constant diameter disposed in the main body member. A radially externally facing taper is formed in the outer surface of the main body member. The taper extends between the armature chamber and the outer surface of the main body member. A stationary pole piece defines a first end of the armature chamber and an end plug defines a second end of the armature chamber. An armature member is positioned in the armature chamber for axial sliding movement relative to and defining a working gap relative to the pole piece. A nonferromagnetic sleeve is positioned on and fixedly connected to the main body member. The sleeve is linearly coextensive with the externally facing taper and at least a portion of the working gap sufficient to permit selected magnetic forces to be exerted on the armature member. A junction of the sleeve and the externally facing taper defining an air gap which extends from the externally facing taper to an internal radial surface of the second body portion. The stationary pole piece and the main body member are manufactured from a single piece of ferromagnetic material and the armature chamber is formed subsequent to fixing the sleeve to the main body member.

BEST MODE FOR CARRYING OUT THE INVENTION

Figure 3:
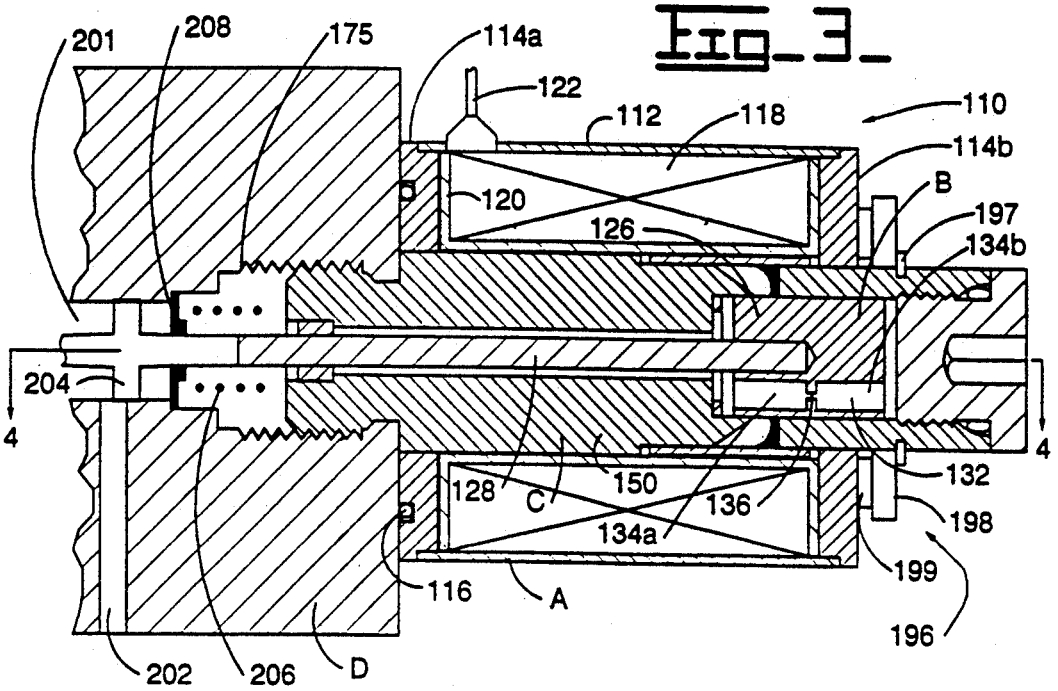
Figure 4:
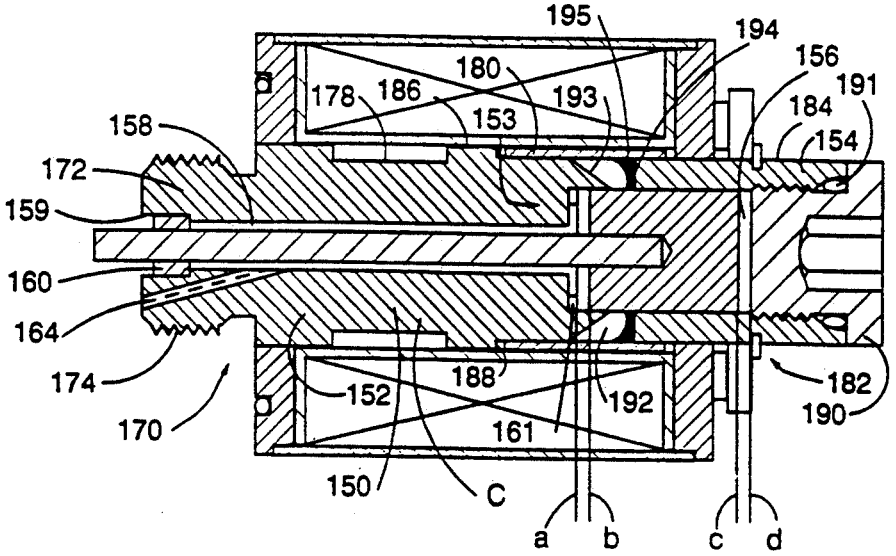

The preferred embodiment of the present invention is illustrated in FIGS. 3 and 4. The construction of the present invention is readily adaptable to proportional solenoids such as those used to operate hydraulic valves. Also, this invention is readily adaptable to push-pull solenoids, as would be apparent to one skilled in the art.

FIGS. 3 and 4 illustrate a solenoid 110 which includes a removable coil unit A, an armature assembly B, and a tube assembly C. In FIG. 3 a known hydraulic valve assembly D is illustrated in connection with the solenoid 110 to aid in the understanding of the present invention. The hydraulic valve assembly D represents a typical application for the solenoid 110. The valve assembly D forms no part of the present invention and should not be construed as limiting the scope of the present invention.

The removable coil unit A is of a construction common in the art and numerous commercially available coils can be adapted to perform the function of the coil unit A, as would be apparent to one skilled in the art. The coil unit A includes an outer housing 112 made of ferromagnetic material. First and second end washers **114*a,b* are made of ferromagnetic material and are press fitted into the housing 112. The first end washer 114*a* is provided with an anti-rotation O-Ring 116. The O-Ring is adapted to frictionally engage a valve housing, for example, thereby preventing rotation of the coil unit A. The outer housing 112 and end washers 114*a,b* encase an electrical winding or coil 118 that is wound on a coil form (bobbin) 120. An electrical conductor 122 is provided for suppling electrical power to the coil 118 for energizing the coil 118**.

The armature assembly B includes an armature 126 and a push pin 128. The armature 126 is machined from a ferromagnetic material such as resulfurized or leaded low-carbon free machining steel. The armature 126 may be constructed from numerous other ferromagnetic materials such as silicon iron steel. The push pin 128 is machined from a nonferromagnetic material such as austenitic stainless steel. The push pin 128 is permanently attached to the armature 126 for movement therewith. Preferably, this is achieved by providing a center bore in the armature 126 and press fitting the push pin 128 into the center bore.

The armature assembly B is designed to minimize the overall mass of the armature 126, thereby increasing the responsiveness of the solenoid 110. In a present embodiment, the armature 126 has a length of approximately 29 mm and a constant outer diameter of approximately 22 mm; however, the exact dimensions of the armature will vary depending on the application and desired performance characteristics. It should be noted that length does not affect the available force from the armature 126. Solenoid force is a function of reluctance and the magnetomotive force (mmf) of the solenoid. The mmf of a solenoid is controlled by the particular coil used in the solenoid. Moreover, reluctance is not affected by either the mass or length ratios of the pole-piece to the armature 126. This is because for a given package size or tube length, the overall reluctance is going to be a constant value. Therefore, a decrease in armature length results in an increase in the pole piece length, and the overall path reluctance will be unchanged. By utilizing a relatively short armature 126, armature mass can be reduced and the response of the solenoid 110 can increased. Using a short armature 126 has the further advantage of allowing a stronger tube assembly C to be constructed, as is explained below.

The armature 126 includes an armature bearing (not shown) which is held in a machined groove (not shown) in the armature 126 and has a slightly larger diameter than the armature's outer surface. Preferably, the bearing is made of either bronze or teflon. Alternatively, the bearing can be in the form of a special armature coating or plating such as electrolysis nickel coating.

Figure 1:
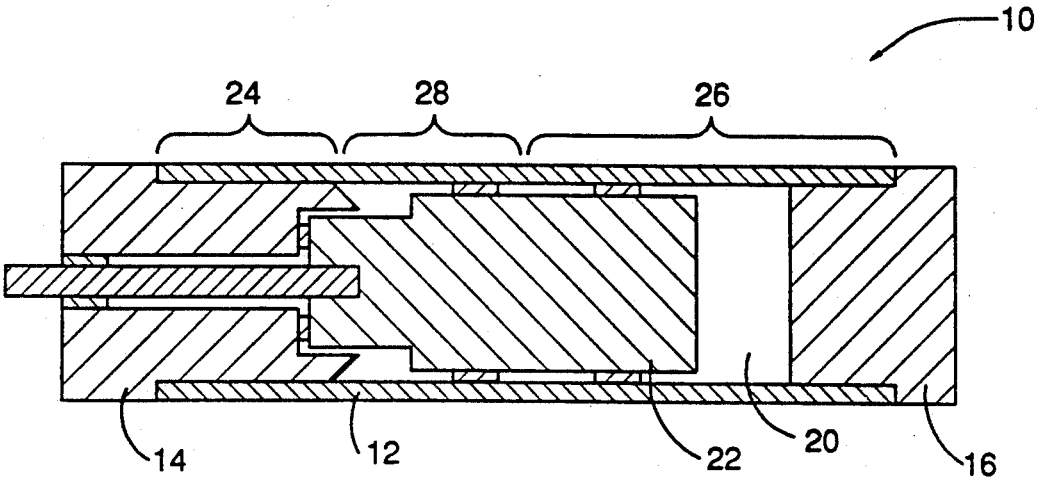
(PRIOR ART) Fig 1
Figure 2:
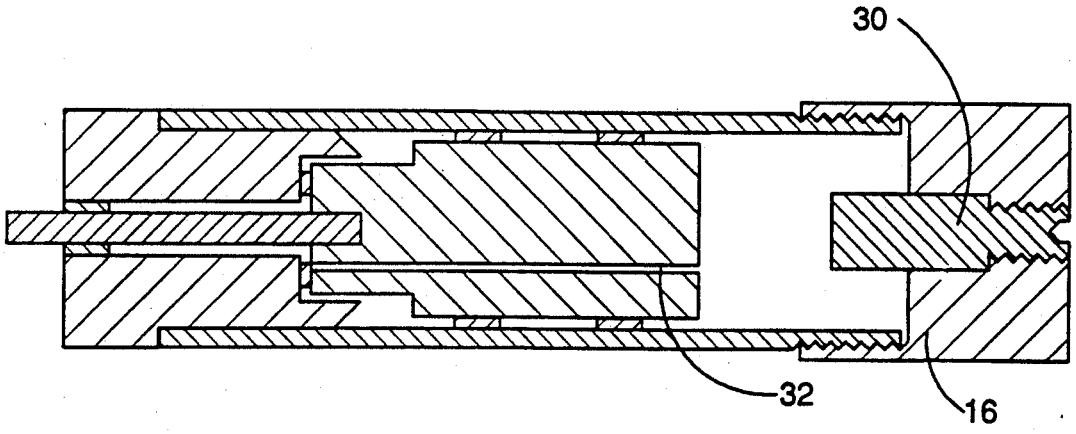
(PRIOR ART) Fig 2

The armature 126 includes a fluid passage 132 which is designed to minimize the effects of oil viscosity on movement of the armature. More specifically, prior solenoids have typically utilized a single longitudinal fluid passage as illustrated in FIG. 2. The fluid passage needs to have a small diameter, because larger diameters do not provide sufficient dampening, especially as temperature increases and, hence, viscosity decreases. However, such fluid passages cause solenoid dampening to vary greatly in response to changes in fluid viscosity as temperature changes. More specifically, a fluid passage of the design shown in FIG. 2 results in laminar flow. The dampening coefficient of such a fluid passage can be represented by the following equation:

$$B = \frac{8 * \pi (D)^4 * \mu * l}{d^4}$$

Where B represents the viscous dampening coefficient through the passage, D represents the diameter of the armature, $\mu$ represents the dynamic fluid viscosity of the fluid, l represents the length of the armature, and d represents the diameter of the fluid passage. As should be apparent from this equation, dampening will vary as a function of the dynamic fluid viscosity $\mu$. This makes it very difficult to maintain good solenoid response over a wide range of operating temperatures.

The present invention incorporates a fluid passage 132 which is adapted to provide nonlaminar flow. The fluid passage 132 includes an increased diameter longitudinal bore 134 and an orifice 136. The orifice 136 is preferably either a short tube orifice or a sharp edged orifice. In FIG. 3, the fluid passage 132 is illustrated as consisting of first and second longitudinal bores 134*a,b* and an orifice 136 which fluidly connects the first and second longitudinal bores 134*a,b*. The Orifice 136 is illustrated as being essentially in the middle of the armature 126; however, it should be apparent that the exact location of the orifice 136 is immaterial in the present invention. For example the orifice 136 could be located at one end of the armature 126 and a single longitudinal bore 134 could be provided. Moreover, the armature 126 could include more than one such fluid passage 132.

Dampening for the increased diameter longitudinal bores 134*a,b* is still represented by the above equation. However, because the orifice diameter is substantially smaller than the diameter of the longitudinal bores 134, dampening of the armature 126 is controlled by the dampening across the orifice 136. The dampening coefficient of the orifice 136 can be represented by the following equation:

$$C = \frac{[\rho * (\pi * D^2/4)^3 * (1 + (d/D)^2]^2}{2(C_d)^2 * (\pi * d^2/4)^2}$$

Where C represents a second order dampening coefficient of the orifice, $\rho$ represents fluid density, and $C_d$ is an empirical value representing the flow coefficient for the orifice 136. The orifice 136 provides nonlaminar flow, and this results in a fluid dampening which is relatively insensitive to kinematic fluid viscosity. This can be appreciated from the fact that dynamic fluid viscosity, $\mu$, is absent the above equation. Because the diameter of the orifice 136 is substantially smaller than the diameter of the longitudinal bores 134*a,b*, the dampening of the armature 126 is controlled by the dampening through the orifice 136, as would be apparent to one skilled in the art. The diameters of the longitudinal bores 134 are preferably between 3 to 4 times larger than the diameter of the orifice 134; however, the exact dimensions required to achieve nonlaminar flow across the orifice 136 and the desired dampening must be determined through lab testing. In an armature having a diameter of approximately 22 mm, the longitudinal bores 134*a,b* preferably have diameters of 5 to 7 mm and the orifice 136 has a diameter 1.5 to 2 mm. A fluid passage of this design has the advantage of providing armature dampening which is relatively insensitive to changes in temperature and fluid viscosity because the armature dampening is controlled by the dampening across the orifice 136 and the orifice 136 provides nonlaminar flow.

Figure 5:
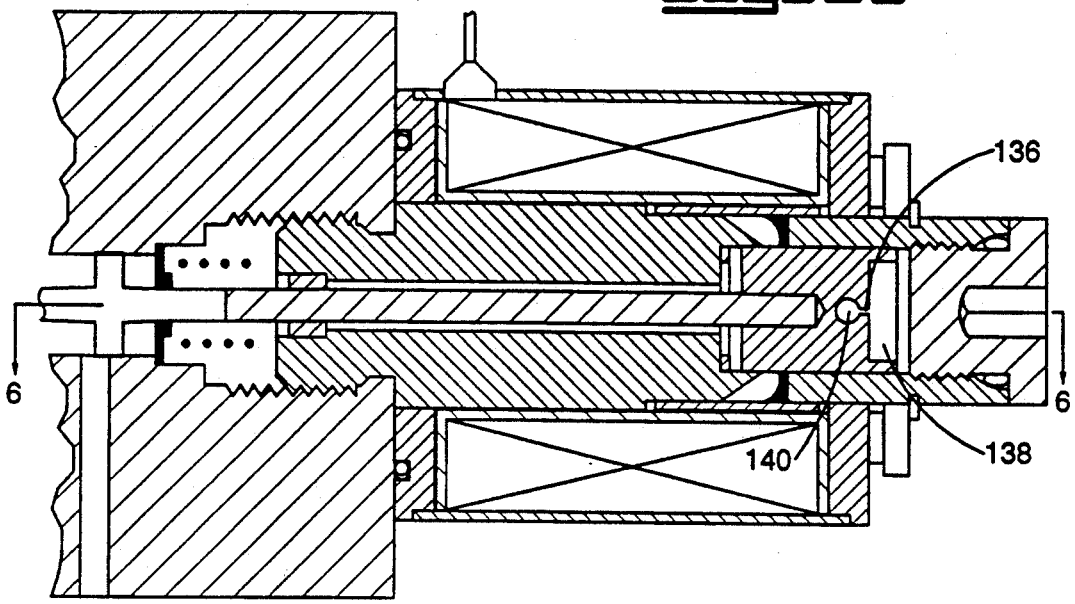
Figure 6:
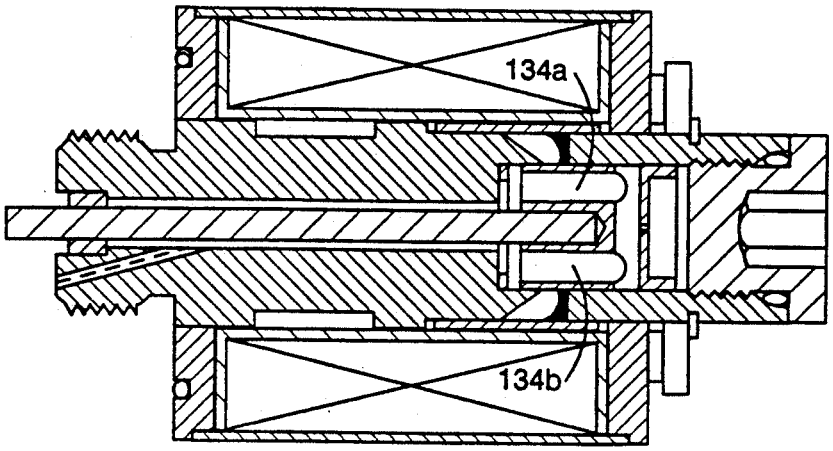

The fluid passage 132 of the present invention can take numerous other forms without departing from the scope of the invention, as would be appreciated by one skilled in the art. The essential requirement is that armature dampening be controlled by an orifice 136 or other passage which provides nonlaminar flow. An alternative embodiment of the fluid passage 132 is illustrated in FIGS. 5 and 6. In FIGS. 5 and 6 the fluid passage 132 includes a counterbore 138 in the end of the armature 126 opposite the push pin 128. The fluid passage 132 further includes a crossbore 140. An orifice 136 is provided for fluidly connecting the counterbore 138 and the crossbore 140. At least one longitudinal bore 134 intercepts the crossbore 140 from the push pin end of the armature 126. In the preferred embodiment two longitudinal bores 134*a,b* are provided. The longitudinal bores 134*a,b* are of a substantially larger diameter than the orifice 126. Preferably the diameters are the same as those given above in connection with FIGS. 3 and 4. A fluid passage of this design does result in approximately a 2–4% loss in available force; however, the resulting insensitivity to viscosity outweighs this force loss.

The tube assembly C will now be described. In order to maintain the clarity of the drawing figures, reference numerals used in describing the tube assembly C have been shown in FIG. 4. Initially, the tube assembly C resembles prior tube assemblies, such as those described in '542 and '600. However, the novel and inventive manner in which the present tube assembly C is manufactured and constructed provides numerous advantages over prior tube assemblies, as will be apparent after a reading of the following description.

The tube assembly C includes a main body member 150 which is made of a ferromagnetic material. Numerous materials are suitable for forming the main body member 150 such as silicon iron steel or resulfurized or leaded low-carbon free machining steel. In the final assembly, as shown in FIGS. 3 and 4, the main body member 150 includes first body portion 152 which forms a stationary pole piece 153 and a second body member 154. However, as explained below, the entire main body member 150 is machined from a single piece of ferromagnetic bar stock, thereby avoiding concentricity problems associated with prior solenoid tube assemblies. The pole piece 153 defines a first end of an armature chamber 156. The armature chamber 156 has a constant diameter and is adapted to receive the armature 126. Because a relatively short armature 126 is used, the present tube assembly C offers increased resistance to side loading when compared to prior solenoids. More specifically, the tube assembly C is structurally weakest at the armature chamber 156 because the tube walls are thinnest in this area. The length of the armature 126 is the controlling factor in the length of the armature chamber 156. Therefore, if the length of the armature 126 is minimized, a stronger tube assembly C is achieved.

The main body member 150 further includes a pin bore 158 which is concentric with the armature chamber 156 and is adapted to receive the push pin 128. A bearing seat 159 is machined in the pin bore 158 near the first end of the main body member 150. A pin bearing 160 is disposed in the bearing seat 159. Preferably, the bearing 160 is a bronze or oil-impregnated sintered bearing. A nonferromagnetic armature stop 161, such as a brass washer, is disposed in the armature chamber 156 between the armature 126 and the pole piece 153.

The main body member 150 includes a pin displacement flow passage 164 for permitting fluid flow between the pin bore 158 and the valve assembly D when the armature 126 moves. A first end portion 170 of the main body member 150 terminates in a valve engaging portion 172 which is preferably in the form of #6 nipple. The valve engaging portion 172 includes male threads 174 on its outer surface for engaging reciprocal female threads 175 in the valve assembly D, thereby enabling the tube assembly C to be screwed into the valve assembly D. Alternatively, the valve engaging portion 172 could include a smooth outer surface and a bolt mount (not shown), such as a four bolt mount, could be used for attaching the solenoid 110 to the valve assembly D, as is common in the art. Wrench flats 178 are machined in the main body member 150 near the first end portion 170. The wrench flats 178 are provided so that a wrench can be used to screw the tube assembly C into the valve assembly D with sufficient torque to prevent fluid leakage.

The tube assembly C also includes a nonferromagnetic sleeve 180 which is preferably made of stainless steel. The sleeve 180 is adapted to slide onto a second end portion 182 of the main body member 150. More specifically, the main body member 150 includes a reduced diameter portion 184 which has an outer diameter which is substantially the same as the inner diameter of the sleeve 180. The main body member 150 also includes an increased diameter portion 186 which preferably has an outer diameter which is substantially the same as the outer diameter of the sleeve 180. The junction of the reduced and increased diameter portions 184,186 form a machined stop 188 which can be used to position the sleeve 180 on the main body member 150 during assembly, as is explained below.

The tube assembly C includes a removable end plug 190 made of nonferromagnetic material such as stainless steel. The end plug 190 defines a second end of the armature chamber 156. In the preferred embodiment the end plug 190 is in the form of a commercially available #5 stainless steel plug. The end plug 190 is adapted to threadably engage the second end portion 182, thereby sealing the armature chamber 156. A sealing washer 191 is disposed between the end plug 190 and the main body member 150 to prevent fluid leakage. Alternatively, an end cap, such as that disclosed in '840, could be used instead of the end plug 190.

The armature member 126 is adapted to slide longitudinally in the armature chamber 156 between the end plug 190 and the armature stop 161. The distance the armature 126 moves is referred to as the armature's working gap. The working gap, as referred to herein, is the distance between the armature 126 and the armature stop 161 when the armature 126 is in its deenergized position, (i.e., when the armature is furthest from the pole piece 153.) In FIGS. 3 and 4, the armature 126 is shown approximately in the middle of its working gap. Therefore, in FIGS. 3 and 4 the working gap can be represented by the sum of the distances between lines a and b and lines c and d. The position of the armature 126 within the chamber 156 is controlled by the magnitude of a magnetic flux path established by the coil 118 and any resistive force exerted on the push pin 128.

A portion of the sleeve surrounds an air gap 192. More specifically, the pole piece 152 includes a radially externally facing taper 193 that is annular and concentric to the center axis of the armature chamber 156. The taper 193 is external to and surrounds a portion of the armature chamber 156. The composite assembly of the main body member 150 and the sleeve 180 form the air gap 192. The ferromagnetic sleeve 180 and the air gap 192 each extend coaxially from an internal radial surface 194 of the second body portion 154 to the intersection of the taper 193 and the sleeve 180. In FIGS. 3 and 4, nonferromagnetic brazing material 195 is shown in a portion of the air gap 193. This brazing material 195 remains after the manufacturing processes, as explained below. Since the brazing material 195 is nonferromagnetic, it has the same effect on magnetic flux as does the air gap 192. The air gap 192 is substantially longer than the working gap of the armature 126. Preferably, the air gap 192 is between 2 and 3 times longer than the working gap of the armature 126. The main design criteria for the air gap 192 is that it be long enough to prevent magnetic flux from shorting between the stationary pole piece 153 and the second body portion 154.

The solenoid 110 further includes a connector means 196 for attaching the coil assembly A to the tube assembly C. In the preferred embodiment, the connector means 196 includes a snap ring 197, a washer 198 and a wave spring 199. The snap ring 197 is adapted to fit in a reciprocal groove 200 (See FIG. 9) in the outer surface of the tube assembly, thereby securing the coil assembly A to the tube assembly C. The connector means 196 can take numerous other forms, such as a threaded fastener, without departing from the scope of the invention.

The valve assembly D as shown in FIG. 3 includes a fluid passage 201 (which is also referred to as an oil passage), a port 202, a spool 204 and a spool return spring 206. The spool 204 can be moved freely in the lateral direction in FIG. 3, and movement of the spool 204 causes the valve to be opened or closed, or the degree of opening of the valve to be increased or decreased. The return spring 206 applies a return force to the spool 204 via a spring seat 208. A spring seat 208 is provided on both the right and left sides (only right-hand spring is shown) of the spool 204 to normally bias the spool 204 to a neutral position in the absence of force from the solenoid 110.

Figures 7, 8, 9:
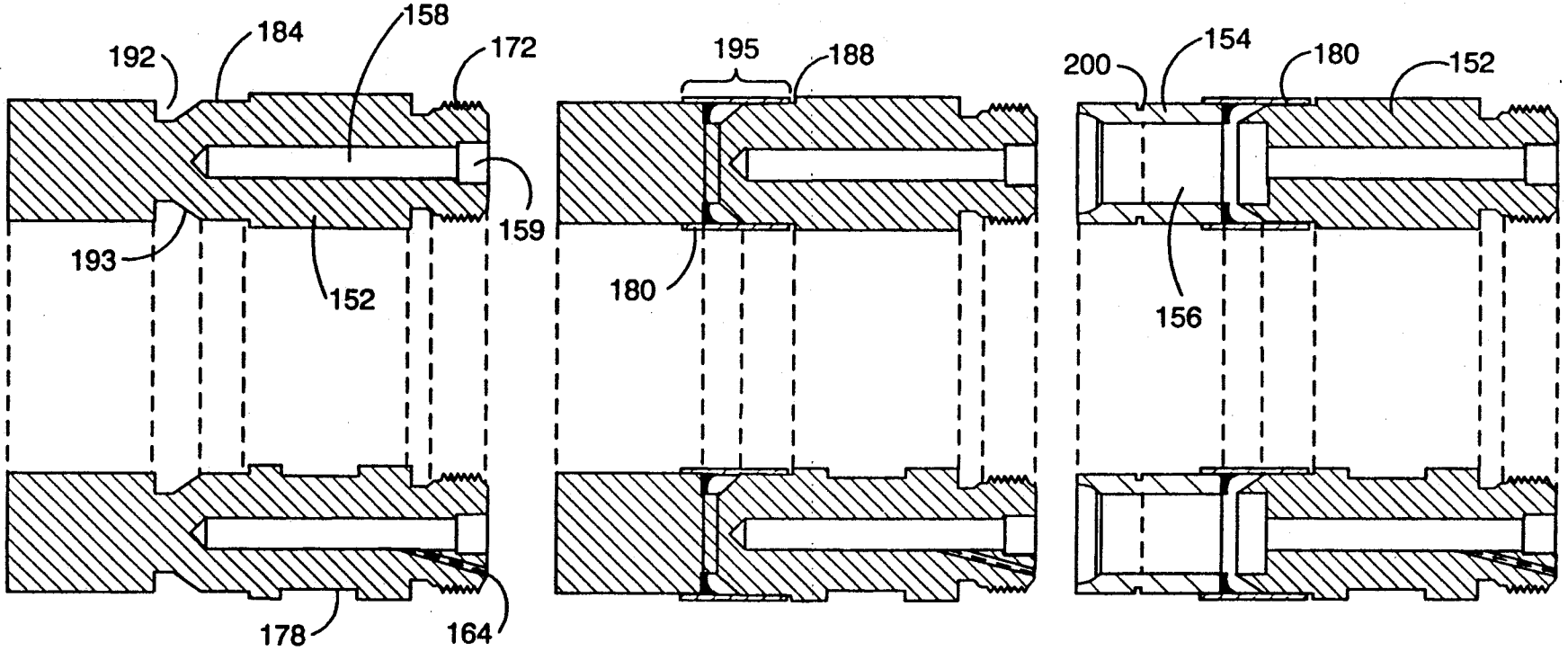

Referring now to FIGS. 7, 8, and 9, steps for manufacturing a tube assembly C in accordance with the present invention are described. Initially, the tube assembly C begins as a solid piece of ferromagnetic cylindrical bar stock. FIG. 7 illustrates the tube assembly A after a first phase of the preferred manufacturing process. In the first phase, the bar stock is placed on a turning machine such as an automated machining lathe. In this phase the outer surface of the main body member 150 is machined to form the wrench flats 178, the valve engaging portion 172, the reduced diameter portion 184, the externally facing taper 193 and the air gap 192. Additionally during the first phase, the pin bore 158, the bearing seat 159 and the pin displacement flow passage 164 are machined into the main body member 150 using boring operations.

FIG. 8 illustrates the tube assembly C after a second phase of the preferred manufacturing process. In the second phase the nonferromagnetic sleeve 180 is slid onto the reduced diameter portion 184 of the main body member 150. Placement of the sleeve 180 on the main body member 150 can be controlled by the machined stop 188. The main criteria is that the sleeve 180 cover the entire air gap 192. Prior to placing the sleeve 180 on the main body member 150 a layer of brazing material 195, such as brazing paste, is applied to the reduced diameter portion 184 where the sleeve 180 overlaps the reduced diameter portion 184. The sleeve 180 is then positioned on the main body member 150 and the composite assembly is joined by furnace brazing. Alternatively, the sleeve 180 and main body member 150 could be joined using laser welding or electron beam welding, as is well known in the art.

FIG. 9 illustrates the tube assembly C after a third phase of the preferred manufacturing process. In the third phase the armature chamber 156 is machined in the main body member 150. Prior to machining the armature chamber 156, the main body member 150 is composed of a single piece of ferromagnetic bar stock. Upon machining the armature chamber 126, the main body member 150 is divided into the first and second body portions 152,154 wherein the two portions are connected by the nonferromagnetic sleeve 180. During this third phase, the second end portion 182 is also machined for receiving the removable end plug 190. After the third machining process and subsequent cleaning, the tube assembly C is ready to be used in the final solenoid assembly.

Industrial Applicability

A solenoid according to the present design has numerous commercial applications. However, a preferable application is felt to be the control of hydraulic valves such as implement valves on construction vehicles. The use of the present solenoid 110 in connection with the valve assembly D will now be described. The solenoid 110 is shipped from its supplier in such a condition (as shown in FIG. 3 with the valve assembly D excluded) that it consists of the removable coil unit A, a tube assembly B and an armature assembly C.

The purchaser of the solenoid 110 connects the solenoid 110 to the valve assembly D in the following manner. First, the tube assembly C is screwed into the reciprocal threads in the valve assembly D. A wrench can be used to screw the tube assembly C into the valve assembly D with sufficient torque to prevent fluid leakage. Next, the coil assembly A is slid onto the tube assembly C. The wave spring 199 and the washer 198 are then positioned on the tube assembly C. Finally, the snap ring 197 is positioned in the reciprocal groove 200, thereby securing the coil assembly A to the tube assembly C. The electrical connector 122 is then connected to a controller means (not shown) which regulates the current applied to the coil 118 to control the position of the armature 126 within the armature chamber 156.

If the solenoid 110 fails, the present design is advantageous because the removable coil assembly A can easily be replaced without removing the tube assembly C from the valve assembly D. This provides the additional advantage of preventing contamination of the hydraulic fluid if the coil assembly A needs to be replaced.

The present solenoid utilizes an end plug 190 which provides numerous advantages. The end plug 190 can easily be removed to check for fluid contamination or for damage to the armature 126. The end plug 190 also allows the armature 126 to be inserted after all brazing, welding, machining and/or cleaning processes have been completed. In solenoids which do not provide a removable end cap, it is possible for the teflon bearing to be damaged by the welding process. Additionally, using a removable end plug 190 allows a single solenoid design to be used for several different applications. More specifically, different end plugs 190 could be developed for performing different functions. For example, an end plug 190 could be provided with a manual override mechanism (not shown) for manually controlling armature position in the event the coil 118 fails. In some applications it might be necessary to purge the valve after the solenoid 110 is connected to the valve assembly. In such applications, the end plug 190 could be equipped with a purging mechanism (not shown) such as that described in '840.

The present solenoid employes a tube assembly C which eliminates many problems associated with prior solenoids. More specifically, concentricity problems associated with prior three-piece tube assemblies are eliminated because the main body member 150 begins as a single piece of bar stock. Moreover, problems due to longitudinal tolerance stackup are minimized by the present design. The only longitudinal tolerances effecting the tube assembly C in the present design are in the length of the armature chamber 156, the length of the armature 126 and the length of the end plug 190. Conversely, prior solenoids which employed three piece tube assemblies had additional tolerances in the length of the pole piece and the guide tube. Moreover, prior guide tubes constructed using a multiple-metal design had additional tolerances where the individual sections were joined. By eliminating most of the tolerance stackup associated with prior tube assemblies, the present design eliminates the need for a set screw, thereby eliminating the problems associated with set screws.

I claim:

1. An assembly for use in a solenoid having an energizable coil, comprising:

a hollow solenoid armature tube adapted to be received in the coil, the armature tube having an armature chamber therein;

a stationary pole piece member defining a first end of the armature chamber;

an end plug defining a second end of the armature chamber; and an armature member having an orifice and a longitudinal bore which are fluidly connected and adapted to provide nonlaminer fluid flow through the armature, the longitudinal bore having a diameter at least three times larger than the diameter of the orifice, and the armature member being positioned in the armature chamber for axial sliding movement relative to and defining a working gap relative to the pole piece.

2. An assembly as set forth in claim 1 wherein the end plug is removable.

3. An assembly for use in a solenoid having an energizable coil, comprising:

a ferromagnetic main body member adapted to be received in the coil, the main body member including first and second body portions and having an armature chamber of a constant diameter disposed therein;

a radially externally facing taper formed in the outer surface of the main body member, the taper extending between the armature chamber and the outer surface of the main body member;

a stationary pole piece disposed in the first body portion and defining a first end of the armature chamber;

an end plug disposed in the second body portion and defining a second end of the armature chamber;

an armature member positioned in the armature chamber for axial sliding movement relative to and defining a working gap relative to the pole piece;

a nonferromagnetic cylindrical sleeve positioned on and being fixedly connected to the main body member, the sleeve being linearly coextensive with the externally facing taper and at least a portion of the working gap sufficient to permit selected magnetic forces to be exerted on the armature member, a junction of the sleeve and the externally facing taper defining an air gap which extends from the externally facing taper to an internal radial surface of the second body portion; and wherein the stationary pole piece, the main body member and the first and second body portions are manufactured from a single piece of ferromagnetic material and the armature chamber is formed subsequent to fixing the sleeve to the main body member.

4. An assembly as set forth on claim 3 wherein the armature member includes a fluid passage adapted to provide nonlaminar fluid flow.

5. An assembly as set forth in claim 4 wherein the armature member includes an orifice and a longitudinal bore which are fluidly connected and adapted to provide nonlaminer fluid flow through the armature, the longitudinal bore having a diameter at least three times larger than the diameter of the orifice.

6. An assembly as set forth in claim 3 wherein the end plug is removable.

7. An assembly as set forth in claim 3 wherein the first body portion further includes a valve engaging portion.

8. A method for providing and assembly for use in a solenoid having an energizable coil, comprising the steps of:

providing a hollow solenoid armature tube adapted to be received in the coil, the armature tube having an armature chamber therein;

providing a stationary pole piece which is disposed in the first body portion and defines a first end of the armature chamber;

providing an end plug which is disposed in the second body portion and defines a second end of the armature chamber; and providing an armature member having an orifice and a longitudinal bore which are fluidly connected and adapted to provide nonlaminar fluid flow through the armature, the longitudinal bore having a diameter at least three times larger than the diameter of the orifice, and the armature member being positioned in the armature chamber for axial sliding movement relative to and defining a working gap relative to the pole piece.

9. An method as set forth in claim 8 wherein the end plug is removable.

10. A method of providing an assembly for use in a solenoid having an energizable coil, comprising the steps of:

providing a ferromagnetic main body member which is receivable in the coil, the main body member including first and second body portions and having an armature chamber of a constant diameter disposed therein;

providing a radially externally facing taper on the outer surface of the main body member;

providing an armature member positioned in the armature chamber for axial sliding movement relative to and defining and armature working gap relative to the pole piece;

attaching a nonferromagnetic sleeve to the main body member, the nonferromagnetic sleeve being linearly coextensive with the radially externally facing taper and at least a portion of the working gap sufficient to permit selected magnetic forces to be exerted on the armature member, a junction of the sleeve and the radially externally facing taper externally facing taper to an internal radial surface of the second end portion; and wherein the armature chamber is formed in the main body member subsequent to attaching the sleeve to the main body member.

11. A method as set forth on claim 10 wherein the armature member includes a fluid passage adapted to provide nonlaminar fluid flow.

12. A method as set forth in claim 11 wherein the armature member includes a fluid passage having an orifice and a longitudinal bore which is fluidly connected to the orifice for allowing nonlaminer fluid flow through the armature, and wherein the longitudinal bore has a diameter at least three times larger than the diameter of the orifice.

13. An method as set forth in claim 10 wherein the end plug is removable.

14. A method as set forth in claim 10 further including the step of providing a valve engaging portion on the first body portion.

* * * * *